US005570102A

United States Patent [19]

Kochiyama et al.

[11] Patent Number: 5,570,102

[45] Date of Patent: Oct. 29, 1996

[54] ENERGY RECEIVING SATELLITE

[75] Inventors: Jiro Kochiyama, Koshigaya; Nobuyuki Kaya, c/o Kobe University of No. 1-1, Rokkodai-cho, Nada-ku, Kobe City, Hyogo Prefecture; Teruo Fujiwara, Hoya; Hidemi Yasui, Musashino; Hiroyuki Yashiro, Tokyo, all of Japan

[73] Assignees: Nissan Motor Co., Ltd., Yokohama; Nobuyuki Kaya, Hyogo Prefecture, both of Japan

[21] Appl. No.: 580,776

[22] Filed: Dec. 29, 1995

Related U.S. Application Data

[63] Continuation of Ser. No. 201,501, Feb. 24, 1994, abandoned.

[30] Foreign Application Priority Data

Feb. 25, 1993 [JP] Japan ..... 5-036629

[51] Int. Cl.[6] ..... H01Q 1/08

[52] U.S. Cl. ..... 343/880; 343/881; 343/DIG. 2

[58] Field of Search ..... 343/705, 706, 343/709, 872, 873, 878, 880, 881, DIG. 2; H01Q 1/08

[56] References Cited

U.S. PATENT DOCUMENTS

| | | | |
|---|---|---|---|
| 2,752,594 | 6/1956 | Link et al. | 343/706 |
| 3,063,048 | 11/1962 | Lehan et al. | 343/705 |
| 3,152,330 | 10/1964 | Chatelain | 343/705 |
| 3,192,529 | 6/1965 | Chatelain | 343/895 X |
| 4,646,102 | 2/1987 | Alkaeda et al. | 343/705 X |
| 4,780,726 | 10/1988 | Archer et al. | 343/881 |
| 4,811,034 | 3/1989 | Kaminskas | 343/DIG. 2 X |
| 4,955,562 | 9/1990 | Martin et al. | 343/705 X |
| 5,019,768 | 5/1991 | Chriswell et al. | 343/DIG. 2 X |

FOREIGN PATENT DOCUMENTS

| | | | |
|---|---|---|---|
| 0113503 | 6/1985 | Japan | 343/881 |

OTHER PUBLICATIONS

Scott, Justin, "Can Microwaves Deliver Power," *Microwaves*, Nov. 1970, p. 14.

Brown, William, "Status of the Use of Microwave Power Transmission Tech in Solar Power Satellites", Space Power, vol. 6, no month, 1986, pp. 305–311.

McIlvenna, John F., "Monolithic Phased Arrays for EHF communications Terminals", *Microwave Journal*, Mar. 1988, pp. 113–125.

Finnell, Woosley, "Solar Power Satellite Microwave Trans. and Recept. system", Energy Conversion Conference, Sep. 1981, pp. 266–271.

Denmun et al, "A Microwave Power Transmission System for Space Satellite Power", Energy Conversion Conference, Sep. 1978, pp. 162–168.

Nalos et al, "Microwave Power Beaming for long range energy transfer," Proceedings of the 8$^{th}$ European Microwave Conference, pp. 573–578 4–8 Sep. 1978.

Koert et al, "Millimeter wave Technology for Space Power Beaming," IEEE Transactions on Microwave Theory and Techniques, Jun. 1992, pp. 1251–1258.

Yoo et al, "Theoretical and Experimental Development of IO and 35GHz Rectennas," IEE Transactions, Jun. 1992, pp. 1259–1266.

Asahi Newspaper, Jul. 4, 1992 issue, Morning edition 13, p. 15.

*Primary Examiner*—Donald T. Hajec
*Assistant Examiner*—Steven Wigmore
*Attorney, Agent, or Firm*—Lowe, Price, LeBlanc & Becker

[57] ABSTRACT

An energy receiving satellite has a curved outer surface on which a plurality of energy signal reception antenna elements are arranged. The satellite may also include a pilot signal generator and a plurality of pilot signal transmission antennas arranged at intervals around the curved outer surface of the satellite. The curved surface is composed of a plurality of curved panels which may be folded in an overlapping condition or unfolded such that the panels are disposed adjacently in a circular arrangement.

6 Claims, 4 Drawing Sheets

ENERGY RECEIVING SATELLITE

This application is a continuation of application Ser. No. 08/201,501 filed Feb. 24, 1994 now abandoned.

BACKGROUND OF THE INVENTION

1. Field of The Invention

The present invention relates generally to an energy receiving arrangement which receive a microwave energy signal from an energy transmission apparatus, such as a solar energy satellite. The energy receiving arrangement may further be active to output a pilot signal in the direction of the energy transmission apparatus for further facilitating energy transmission. In particular, the invention relates to a solar energy receiving satellite which may be made lightweight, compact and simple of construction.

2. Description of The Related Art

Solar Power Satellites (SPS) have recently been proposed for collecting solar electrical energy and transmitting same to be received and utilized at remote locations. The collected energy would be transmitted via microwave to, for example, an orbital space station, factory, or a location on earth or another celestial body. For establishing such a system of energy transfer, efficient receiving and transmission apparatus are required.

One such system of solar energy collection/transmission has been described in the Jul. 14, 1992 issue of the Asahi Newspaper, morning edition 13, page 15. The disclosed arrangement describes an earth launched solar energy collection/transmission satellite. The satellite is adapted to mount a plurality of subarray assemblies to transmit solar energy in a direction from which a microwave pilot signal, aimed at the satellite from a remote energy receiving apparatus, is received.

For realizing such an energy transmission arrangement, for guiding an energy transmission wave and phase control of a generated microwave signal, a microwave pilot signal is emitted from the energy receiving apparatus and the subarrays of the energy transmission satellite are active to transmit electrical energy back in a target direction from which the pilot signal is received.

However, according to this arrangement, the energy receiving apparatus, which may be provided on a satellite, space station, or the like, comprises a flat surface on which a plurality of receiving antennas, or 'rectennas' are provided. According to this, it is necessary to provide the energy receiving apparatus with means of detecting the direction of the transmission satellite and for enabling the apparatus to always assure that the rectenna elements are facing in the correct direction for receiving the microwave energy signal. Thus, a size and weight of the receiving apparatus becomes great, and, in addition, the cost and complexity of the apparatus is also increased.

Thus, is has been required to provide an energy receiving apparatus, for use with an energy transmission system, for use in space, for example, which may be made compact, lightweight, and simple in structure.

SUMMARY OF THE INVENTION

It is therefore a principal object of the present invention to overcome the drawbacks of the related art.

It is a further object of the present invention to provide an energy receiving apparatus, for use with an energy transmission system, which is compact, lightweight, and simple in structure.

In order to accomplish the aforementioned and other objects, an energy receiving apparatus receivable of an energy signal from an energy signal transmission apparatus at a remote location is provided, comprising: a curved mounting surface, and energy signal receiving means including a plurality of reception antenna elements disposed over an outer side of the curved mounting surface.

According to another embodiment of the invention, an energy receiving satellite receivable of an microwave energy signal from a solar energy transmission satellite at a remote location is disclosed, comprising: a curved mounting surface, microwave signal receiving means including a plurality of reception antenna elements disposed over an outer side of the curved mounting surface, pilot signal generating means, and pilot signal transmission means including a plurality of pilot signal transmission antennas arranged at intervals around the outer side of the curved mounting surface.

DESCRIPTION OF THE PREFERRED EMBODIMENT

Figure 1:
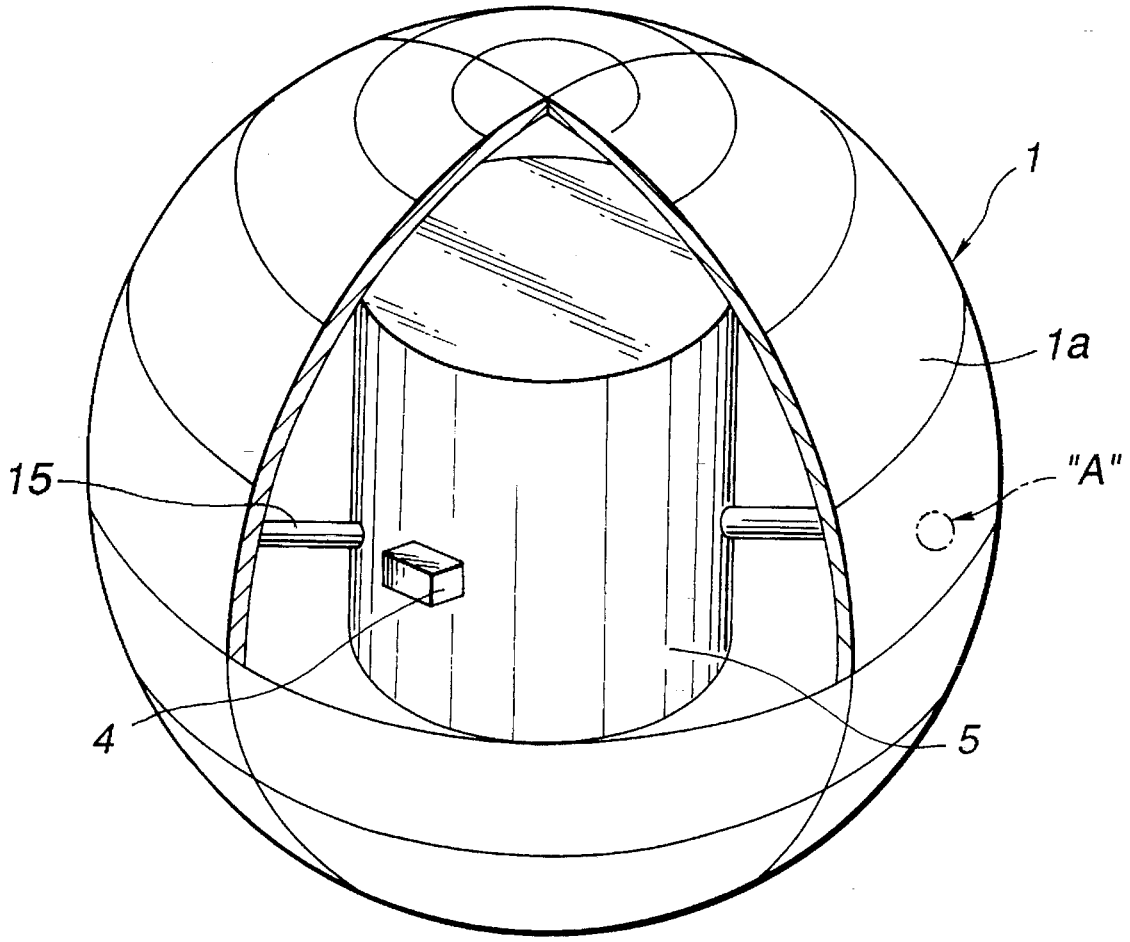
FIG. 1 is a partially cut-away perspective view of an energy transmission satellite according to a preferred embodiment of the invention.

Referring now to the drawings, particularly to FIG. 1, a preferred embodiment of an energy receiving satellite 1 according to the invention will be described in detail.

Figure 2:
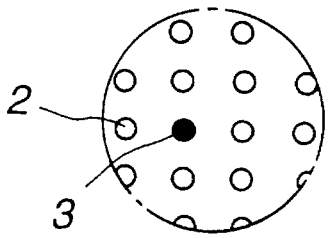
FIG. 2 is an enlarged view of surface structure within the circle 'A' of FIG. 1.

As may be seen, the satellite 1 has a substantially spherical outer surface 1*a* on which, as may be seen in FIG. 2, a plurality of energy signal rectennas (receiving antennas) 2 are disposed in an evenly spaced pattern. Also referring to FIG. 2, the outer surface 1*a* mounts a plurality of pilot signal transmitting antennas 3 which are provided at intervals around the outer surface 1*a*. As may be seen from FIG. 3, where the transmitting antennas 3 are indicated by black circles, relatively few of the transmitting antennas 3 are provided as compared with the number of rectennas 2.

As seen in FIG. 1, the inner structure of the satellite 1 may include a control unit 4 for handling mission telemetry, or the like, and a compartment 5, which may be utilized for housing an experiment or user device. The compartment is supported within the spherical outer surface 1 by support members 15.

Referring now to FIGS. 3–6 an embodiment of the invention will be described in which the outer surface is enabled to assume folded and unfolded positions for allowing ease of transport and/or storage as well as increasing compactness of the energy receiving satellite 1.

Figure 3:
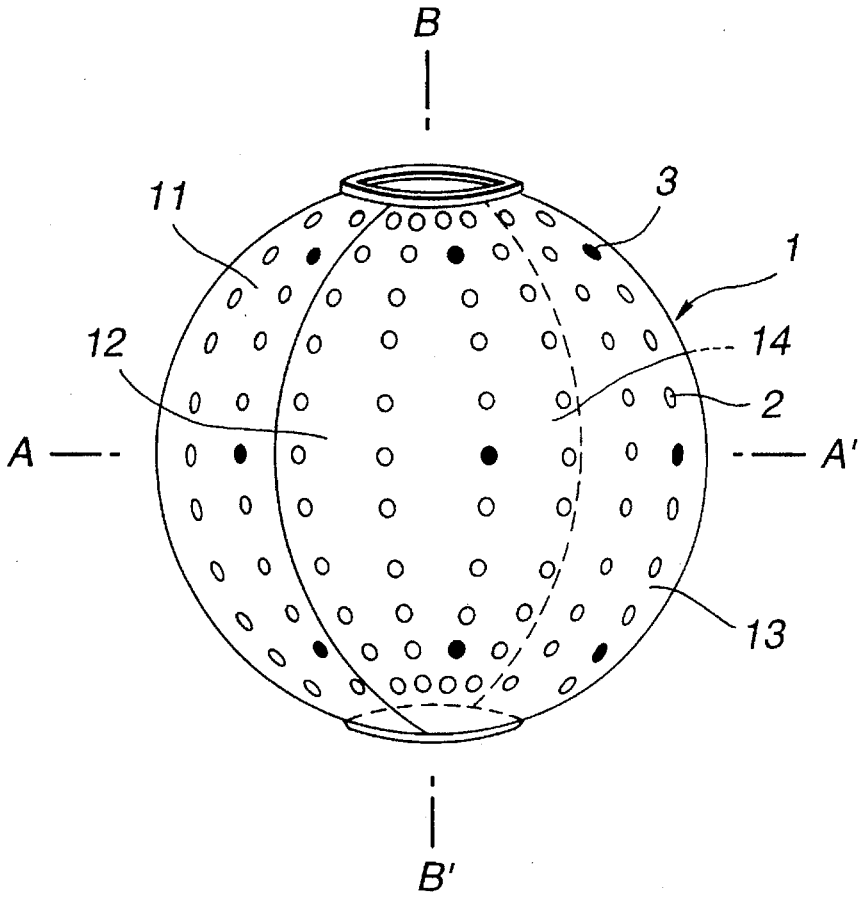
FIG. 3 is a side view of the energy transmission satellite of the invention.
Figure 4:
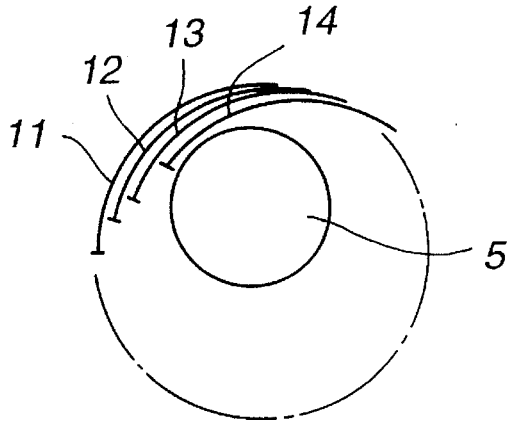
FIG. 4 is a plan view of the satellite of the invention in a folded condition of subarray panels thereof.
Figure 5:
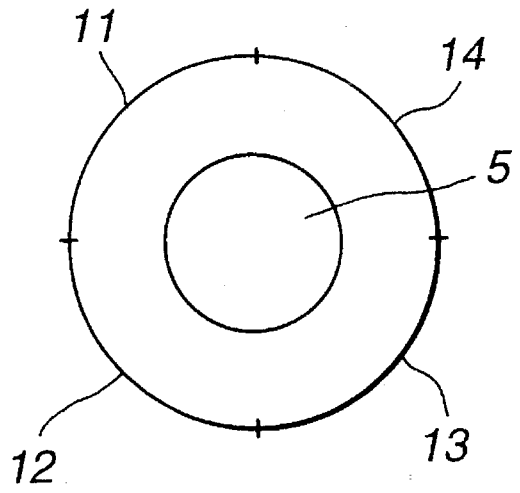
FIG. 5 is a plan view of the satellite of FIG. 4 in an assembled condition wherein the subarray panels are unfolded.

According to the present embodiment, instead of a single, spherical outer surface 1*a*, the outer surface of the satellite 1 is comprised of surface panels 11–14. As seen in FIG. 3, the surface panels 11–14 collectively mount the plurality of rectennas 2 and antennas 3 as described above. In an unfolded condition of the surface panels, as shown in FIG. 5 (taken along line A—A of FIG. 3), the surface panels 11–14 are arranged substantially adjacent to each other while, referring to FIG. 4 (also taken along line A—A of FIG. 3), in a folded condition of the satellite 1, the surface panels 11–14 are arranged so as to overlap one another at one side of the compartment 5. It will be understood that folding and unfolding operation of the satellite 1 may be accomplished manually or automatically via a servo motor or the like.

Figure 6:
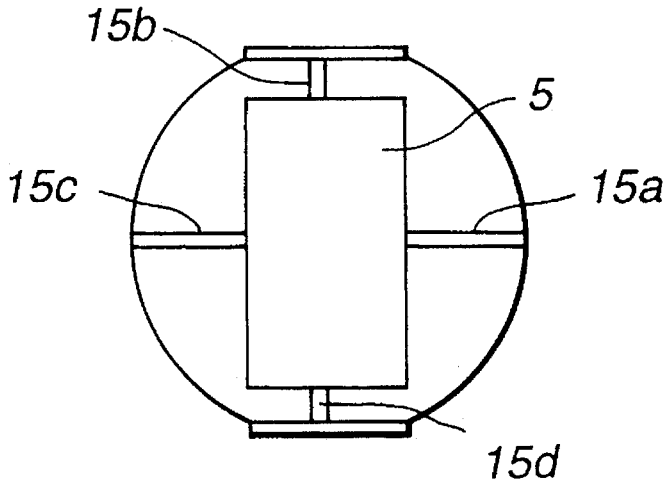
FIG. 6 is a cross-sectional view taken along line B—B of FIG. 3, showing an internal structure of the satellite.

FIG. 6 shows a cross-sectional view of the satellite 1 according to the invention. As may be seen, the compartment 5 may be supported at four sides by support members 15*a*–15*d* for retaining the surface panels 11–14 reliably in position around the compartment 5.

Figure 7:
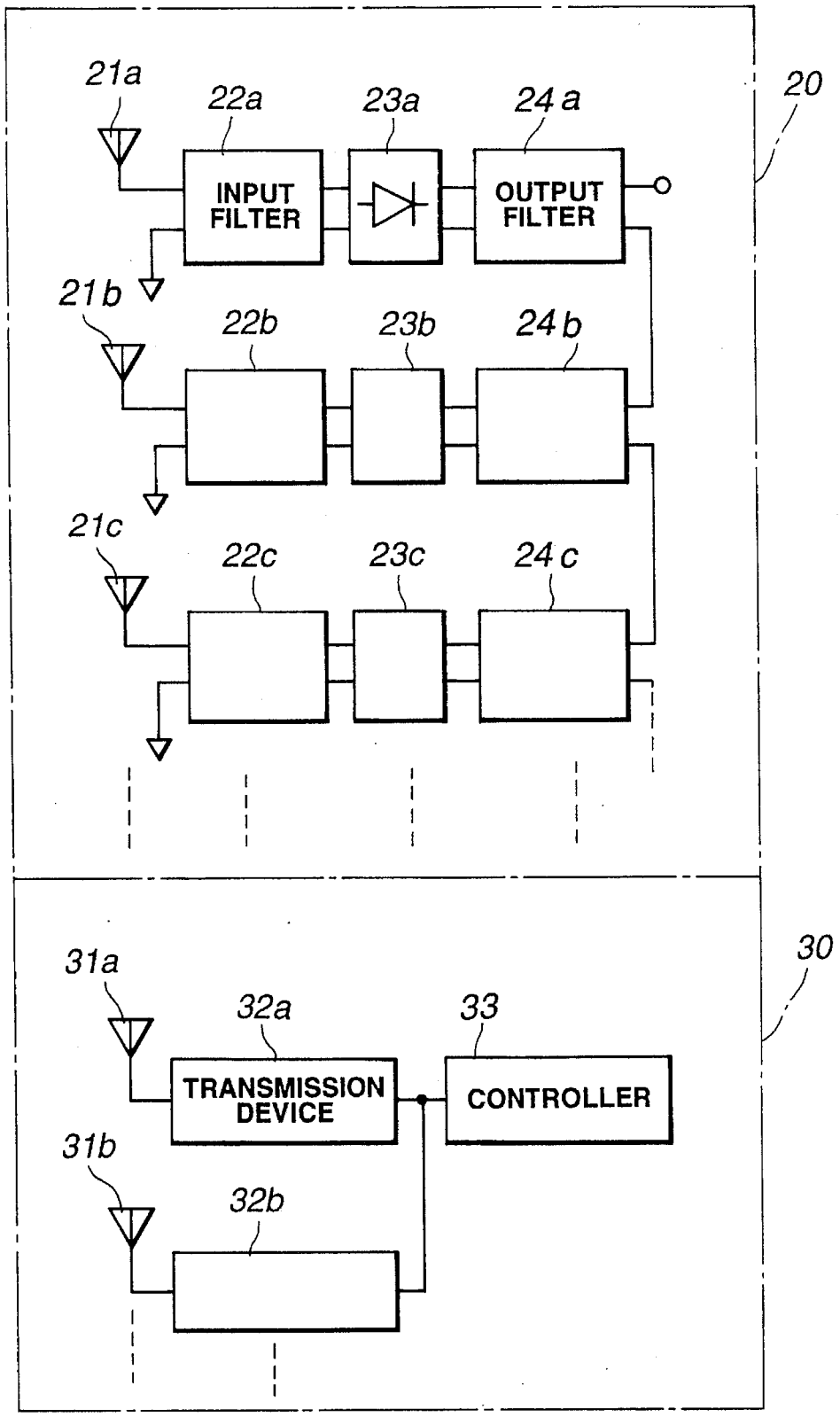
FIG. 7 is a block diagram of reception/transmission circuitry according to a preferred embodiment according to the invention.

Hereinbelow, a reception/transmission circuit for the energy receiving satellite 1 of according to preferred embodiment will be described with reference to FIG. 7.

Referring to the drawing, a reception portion 20 of the satellite 1 associated with each of the rectennas 1 comprise energy signal receiving antenna elements, 21*a*, 21*b*, 21*c* . . . , having respective input filters 22*a*, 22*b*, 22*c*, etc. Each of the input filters 22*a*, 22*b*, . . . is respectively connected to a rectifier 23*a*, 23*b*, 23*c* . . . which are connected to respective output filters 24*a*, 24*b*, 24*c* . . . , the outputs of the output filters 24*a*, 24*b*, 24*c* . . . being connected in series.

As may be understood from the above, a microwave energy signal from an energy transmission apparatus (not shown) is received at each of the energy signal receiving antenna elements 21 to be output at the output filter 24 via the rectifier 23, at which the microwave signal is rectified to be output from the output filter as an electrical voltage. According to the series connection of the plurality of output filter a high conversion efficiency of electrical power from the received energy signal may be realized.

Also, a transmission portion 30 of the satellite 1 is provided which is associated with each of the pilot signal transmission antennas 3. The transmission portion 30 comprises transmission antenna elements 31*a*, 31*b* . . . , coupled with respective signal transmission devices 32*a*, 32*b* , . . . collectively connected to a controller 33.

According to this, the pilot signal generated at the controller 33 is emitted from each of the antenna elements 31 via the transmission device 32. Thus, when the pilot signal is received at an energy transmission satellite (not shown) the direction of the energy transmission satellite 1 can be calculated at the transmission satellite for aiming the microwave energy signal correctly. Further, the signal levels of the pilot signal and the microwave signal are set such that the pilot signal may be broadcast during reception of the incoming microwave energy signal without interference.

It will be noted the invention, thus provides an energy receiving satellite operable with an energy transmission satellite system which is compact, simple in design and low in cost.

Also, due to the spherical shape of the energy receiving satellite 1 according to the invention, around which the rectennas 2 are disposed, the satellite may continuously receive the energy signal from the transmission source (not shown) without need to provide additional positional controlling components for aiming the rectennas. Thus, the weight, size and cost of the satellite may be further reduced.

While the present invention has been disclosed in terms of the preferred embodiment in order to facilitate better understanding thereof, it should be appreciated that the invention can be embodied in various ways without departing from the principle of the invention. Therefore, the invention should be understood to include all possible embodiments and modification to the shown embodiments which can be embodied without departing from the principle of the invention as set forth in the appended claims.

What is claimed is:

1. An energy receiving apparatus receivable of an energy signal from an energy transmission apparatus at a remote location, comprising:

a central compartment;

a plurality of movably mounted panels contoured as uniformly sized, longitudinally extending, partial sphere segments;

energy signal receiving means including an arrangement of reception antenna elements respectively disposed on an outer surface of each of said panels; and support means attached to an outer side of said central compartment and including extending portions respectively attached to an inner side of each of said panels, said support means enabling movement of said panels commonly around a central longitudinal axis at least between;

a first position, wherein each longitudinal edge of each panel fully contacts a longitudinal edge of an adjacent panel so as to collectively define a substantially spherical satellite body enclosing said compartment; and a second position wherein inner and outer surfaces of said plurality of panels are overlapped at one side of said compartment.

2. An energy receiving apparatus as set forth in claim 1, further including pilot signal generating means and pilot signal transmission means disposed on each panel.

3. An energy receiving apparatus as set forth in claim 2, wherein said pilot signal transmission means comprises a plurality of pilot signal transmission antennas arranged at intervals on each of said panels so as to extend around said spherical satellite body when said panels are disposed at said first position.

4. A satellite structure as set forth in claim 1, further including servo means for automatically effecting movement of said panels between said first and second positions.

5. A satellite structure as set forth in claim 1, further including an energy receiving portion associated with each of said antenna elements and including a plurality of input filters respectively connected to one of said antenna elements, each input filter also being connected to a corresponding plurality of rectifiers, each of which is connected to a respective output filter, the outputs thereof being connected in series.

6. A satellite structure as set forth in claim 1, further including a transmission portion including a plurality of transmission antenna elements disposed on said outer surfaces of said panels, each of said transmission antenna elements respectively coupled with one of a corresponding plurality of signal transmission devices, said signal transmission devices being collectively connected to a controller such that a signal generated at said controller is emitted from each of the antenna elements via the transmission device.

* * * * *